US010249244B2

(12) United States Patent
Kim et al.

(10) Patent No.: US 10,249,244 B2
(45) Date of Patent: Apr. 2, 2019

(54) CALIBRATION DEVICE AND METHOD AND ORGANIC LIGHT-EMITTING DISPLAY INCLUDING THE SAME

(71) Applicant: LG Display Co., Ltd., Seoul (KR)

(72) Inventors: Seungtae Kim, Goyang-si (KR); Myunggi Lim, Ansan-si (KR); Seokhyun Hong, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/631,860

(22) Filed: Jun. 23, 2017

(65) Prior Publication Data

US 2018/0005580 A1 Jan. 4, 2018

(30) Foreign Application Priority Data

Jun. 30, 2016 (KR) ..... 10-2016-0082729

(51) Int. Cl.

*G09G 5/00* (2006.01)
*G09G 3/3258* (2016.01)
*G09G 3/00* (2006.01)

(52) U.S. Cl.

CPC ..... *G09G 3/3258* (2013.01); *G09G 3/006* (2013.01); *G09G 2320/0285* (2013.01); *G09G 2320/043* (2013.01); *G09G 2320/0693* (2013.01); *G09G 2330/12* (2013.01)

(58) Field of Classification Search

CPC ..... G09G 3/3258; G09G 3/006; G09G 2320/0285; G09G 2320/043; G09G 2330/12; G09G 2320/0693

See application file for complete search history.

(56) References Cited

U.S. PATENT DOCUMENTS

2008/0315788 A1* 12/2008 Levey ..... G09G 3/3233 315/291
2013/0093651 A1* 4/2013 Odawara ..... G09G 3/3233 345/76
2013/0169310 A1* 7/2013 Woo ..... G01R 31/40 324/764.01
2017/0287414 A1* 10/2017 Uriostigue ..... G09G 3/2003

* cited by examiner

*Primary Examiner* — Adam R. Giesy
(74) *Attorney, Agent, or Firm* — Polsinelli PC

(57) ABSTRACT

An organic light-emitting display comprises: a display panel with a plurality of pixels; a plurality of source driver ICs comprising sensing blocks that are connected to the pixels and sense the electrical characteristics of the pixels; and a calibration block that applies test currents to the sensing blocks in order to sense offset variations between the sensing blocks in a preset calibration mode. The calibration block comprises: a plurality of discrete current sources that generate the test currents; and a switch array that connects the source driver ICs and the discrete current sources, wherein two or more neighboring source driver ICs share one discrete current source, and each source driver IC is selectively connected to two or more discrete current sources.

20 Claims, 17 Drawing Sheets

CALIBRATION DEVICE AND METHOD AND ORGANIC LIGHT-EMITTING DISPLAY INCLUDING THE SAME

CROSS REFERENCE TO RELATED APPLICATION

This application claims the priority benefit of Korean Patent Application No. 10-2016-0082729 filed on Jun. 30, 2016, which is hereby incorporated by reference in its entirety for all purposes as if fully set forth herein.

BACKGROUND OF THE DISCLOSURE

Field of the Disclosure

The present disclosure relates to an organic light-emitting display, and more particularly, to a device and calibration method and an organic light-emitting display including the same that is capable of sensing and compensating for variations in electrical characteristics of its pixels.

Discussion of the Background

An active-matrix organic light-emitting display comprises self-luminous organic light-emitting diodes (hereinafter, "OLED"), and has the advantages of a fast response time, a high luminous efficiency, a high brightness, and a wide viewing angle.

An OLED, which is a self-luminous device, comprises an anode, a cathode, and organic compound layers HIL, HTL, EML, ETL, and EIL formed between the anode and cathode. The organic compound layers comprise a hole injection layer HIL, a hole transport layer HTL, an emission layer EML, and an electron transport layer ETL, and an electron injection layer EIL. When a driving voltage is applied to the anode and the cathode, a hole passing through the hole transport layer HTL and an electron passing through the electron transport layer ETL move to the emission layer EML, forming an exciton. As a result, the emission layer EML generates visible light.

In an organic light-emitting display, pixels each comprising an OLED are arranged in a matrix form, and brightness is adjusted by controlling the amount of light emitted from the OLED according to the grayscale data of an image. Each pixel comprises a driving element, i.e., driving TFT (thin-film transistor), that controls a pixel current flowing through the OLED based on the voltage applied between its gate electrode and source electrode. The electrical characteristics of the OLED and the driving TFT may worsen with time, thus causing differences between pixels. Such variations in electrical characteristics between pixels are the main reason for a low picture quality.

There is a known external compensation technology that compensates for variations in electrical characteristics between pixels, in which sensing information corresponding to the electrical characteristics (the driving TFT's threshold voltage, the driving TFT's mobility, and the OLED's threshold voltage) of pixels is measured, and an external circuit modulates image data based on the sensing information.

In this external compensation technology, the electrical characteristics of pixels are sensed by using a sensing block embedded in a source driver IC (i.e., integrated circuit). The sensing block comprises a plurality of current integrators, a plurality of sample and holders, and an ADC (i.e., analog-to-digital converter). A current integrator performs an integration of current information of pixels input through sensing channels to produce a sensed voltage. This sensed voltage is passed to an ADC (analog-to-digital converter) through a sample and holder, and converted to digital sensing data by the ADC. A timing controller calculates a pixel compensation value for compensating for variations in the electrical characteristics of pixels based on the digital sensing data from the ADC, and corrects the input image data based on the pixel compensation value.

Since the organic light-emitting display comprises a plurality of source driver ICs for driving the display panel area by area in a segmented fashion, a plurality of sensing blocks, each embedded in each source driver IC, sense the pixels on the display panel area by area in a segmented fashion. When pixels are sensed in a segmented fashion by a plurality of sensing blocks, sensing accuracy may be low due to offset variations between the sensing blocks. Thus, it is necessary to compensate for offset variations between the sensing blocks by a calibration process. In the calibration process, a test current is applied to each sensing block to obtain sensing data for calibration, and a compensation value for calibration, for compensating for offset variations between the sensing blocks, is calculated based on the sensing data for calibration. The timing controller can improve compensation accuracy by referring to the compensation value for calibration, as well as the pixel compensation value, when correcting the input image data.

FIGS. 1A to 2B depict a calibration method according to the related art.

A first calibration method in the related art shown in FIGS. 1A and 1B uses one common current source Ix for applying a test current to three sensing blocks included in three source drivers SIC1, SIC2, and SIC3. In this calibration method, a test current is applied sequentially to the three sensing blocks by alternately turning on switches SW1, SW2, and SW3 connected between the common current source Ix and the source driver ICs SIC1, SIC2, and SIC3.

A second calibration method in the related art shown in FIGS. 2A and 2B uses three discrete current sources I1, I2, and I3 for applying test currents to three sensing blocks included in three source drivers SIC1, SIC2, and SIC3. In this calibration method, a test current is applied simultaneously to the three sensing blocks through the discrete current sources I1, I2, and I3.

The first calibration method generates no calibration errors due to variations between the current sources because it uses the common current source Ix, but has a problem of increased tack time as shown in FIG. 3 since all of the source drivers ICs SIC1, SIC2, and SIC3 have to be sequentially calibrated with the one common current source Ix.

The second calibration method has the benefit of decreased tack time since the source drivers ICs SIC1, SIC2, and SIC3 are simultaneously calibrated with the discrete current sources I1, I2, and I3, but it generates calibration errors due to variations between the discrete current sources I1, I2, and I3, as shown in FIG. 4.

SUMMARY

Accordingly, the present disclosure is directed to a device and a calibration method, and an organic light emitting display including the same that substantially obviate one of more problems due to limitations and disadvantages of the prior art.

The present disclosure is also to provide a calibration device and method that can reduce time needed for calibration and minimize calibration errors, and an organic light-emitting display including the same.

Additional features and advantages of the disclosure will be set forth in thre description which follows and in part will be apparent from the description, or may be learned by practice of the disclosure. Other advantages of the disclosure will be realized and attained by the structure particularly pointed out in the written description and claims hereof as well as the appended drawings.

To achieve these and other advantages and in accordance with the purpose of the present disclosure, as embodied and broadly described, an organic light-emitting display includes a display panel with a plurality of pixels; a plurality of source driver ICs comprising sensing blocks that are connected to the pixels and sense the electrical characteristics of the pixels; and a calibration block that applies test currents to the sensing blocks. The calibration block comprises: a plurality of discrete current sources that generate the test currents; and a switch array that connects the source driver ICs and the discrete current sources, wherein two or more neighboring source driver ICs share one discrete current source, and each source driver IC is selectively connected to two or more discrete current sources.

The switch array includes first switches that connect a first discrete current source to a first source driver IC, a second discrete current source to a second source driver IC, and a third discrete current source to a third source driver IC; and second switches that connect the second discrete current source to the first source driver IC, the third discrete current source to the second source driver IC, and a fourth discrete current source to the third source driver IC.

The switch array further includes third switches that connect the third discrete current source to the first source driver IC, the fourth discrete current source to the second source driver IC, and a fifth discrete current source to the third source driver IC.

The first switches turn on simultaneously only during a first sensing period, the second switches turn on simultaneously only during a second sensing period subsequent to the first sensing period, and the third switches turn on simultaneously only during a third sensing period subsequent to the second sensing period.

The sensing block of each source driver IC is sequentially connected to the two or more discrete current sources through a plurality of sensing periods, and generates sensing data for calibration of multiple times corresponding to the test currents applied from the two or more discrete current sources.

The organic light-emitting display further includes a timing controller that processes the sensing data for calibration of multiple times. The timing controller comprises: a sensing data corrector that compares the sensing data for calibration of multiple times to extract correction values for compensating for variations between the discrete current sources and to correct the sensing data for calibration of multiple times with the correction values; and a compensation value calculator that calculates a compensation value for calibration, for compensating for offset variations between the sensing blocks, based on the corrected sensing data for calibration.

In another aspect of the present disclosure includes a calibration method for an organic light-emitting display, in which test currents are applied to sensing blocks by using a plurality of discrete current sources, the calibration method comprising: obtaining sensing data for first calibration by connecting a first source driver IC to a first discrete current source, a second source driver IC to a second discrete current source, and a third source driver IC to a third discrete current source, during a first sensing period; obtaining sensing data for second calibration by connecting the first source driver IC to the second discrete current source, the second source driver IC to the third discrete current source, and the third source driver IC to a fourth discrete current source, during a second sensing period subsequent to the first sensing period; and comparing the sensing data for calibration of multiple times to extract correction values for compensating for variations between the discrete current sources and to correct the sensing data for calibration of multiple times with the correction values.

In yet another aspect of the present disclosure, a calibration device for applying test currents to sensing blocks embedded in source driver ICs, the calibration device includes a plurality of discrete current sources that generate the test currents; and a switch array that connects the source driver ICs and the discrete current sources, wherein two or more neighboring source driver ICs share one discrete current source, and each source driver IC is selectively connected to two or more discrete current sources.

In a further aspect of the present disclosure, a calibration device for minimizing an error and a tack time in calibrating an organic light emitting display includes a plurality of sensing blocks outputting sensing data for at least two calibrations through an analog-to-digital converter corresponding to a plurality of test currents in a calibration mode; a calibration block applying the plurality of test currents to the sensing blocks, wherein the test currents are selectively applied to the sensing blocks through at least two discrete current sources in the calibration mode; and a timing controller calculating a pixel compensation value for compensating for variations in electrical characteristics of pixels based on the sensing data in a sensing mode and compensating for input image data based on the pixel compensation value.

It is to be understood that both the foregoing general description and the following detailed description are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate aspects of the disclosure and together with the description serve to explain the principles of the disclosure.

In the drawings.

DETAILED DESCRIPTION

Figure 1A:
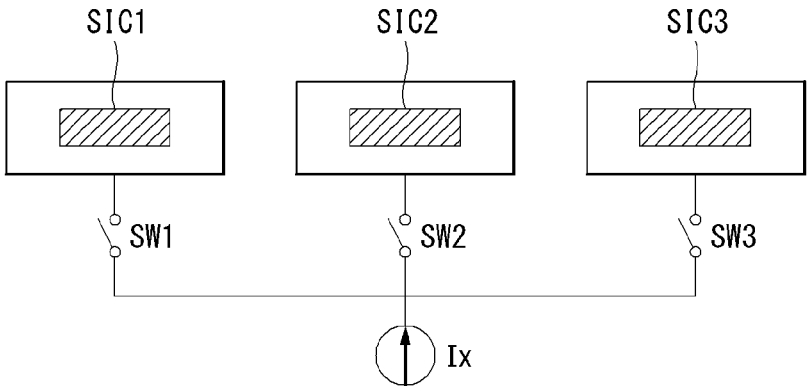
FIG. 1A (RELATED ART)
FIGS. 1A and 1B are views showing a first calibration method according to the related art.
Figure 1B:
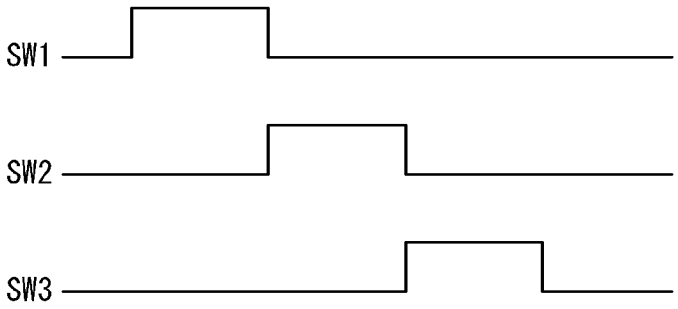
FIG. 1B (RELATED ART)
Figure 2A:
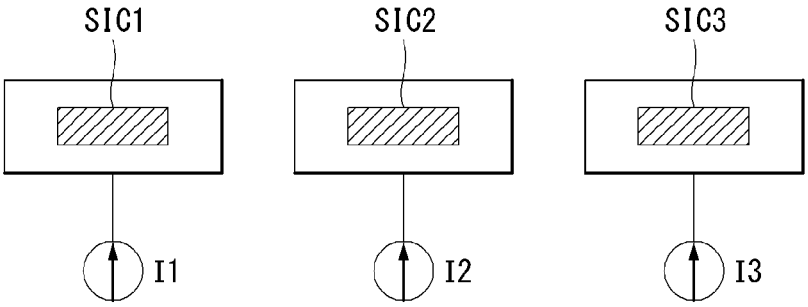
FIG. 2A (RELATED ART)
FIGS. 2A and 2B are views showing a second calibration method according to the related art.
Figure 2B:
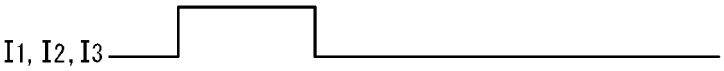
FIG. 2B (RELATED ART)
Figure 3:
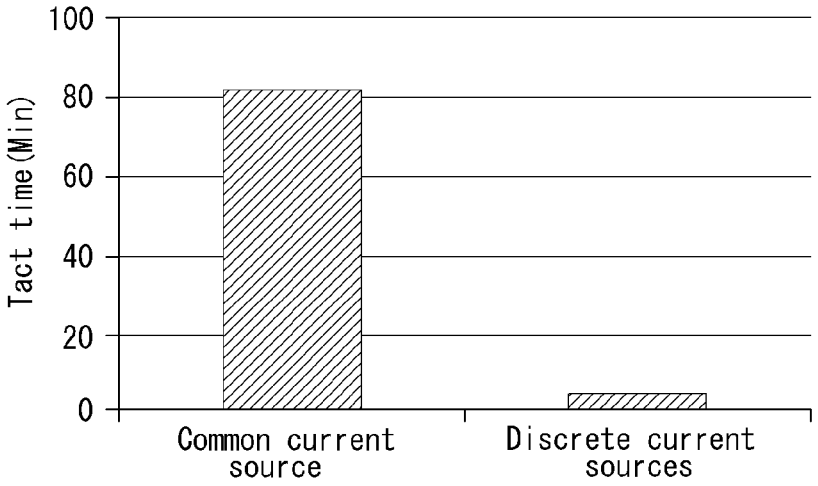
FIG. 3 (RELATED ART)
FIG. 3 is a view showing increased tack time in the first calibration method in the related art.
Figure 4:
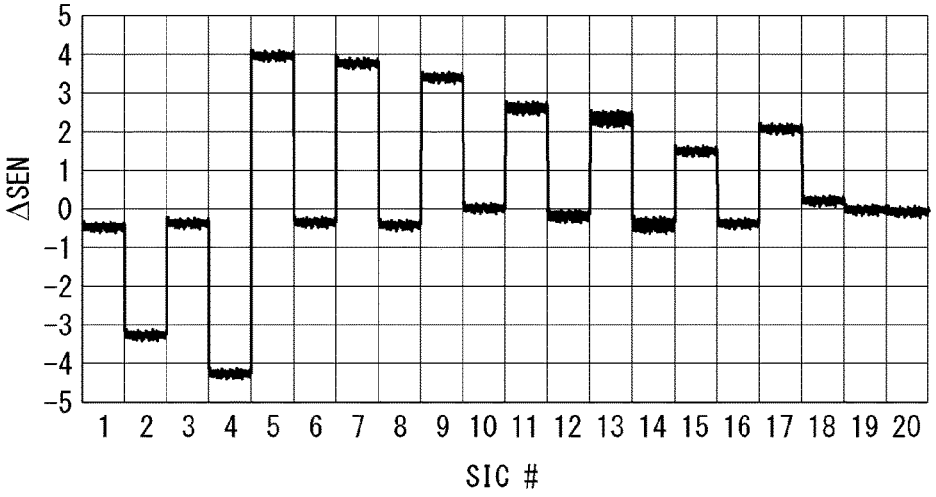
FIG. 4 (RELATED ART)
FIG. 4 is a view showing variations in sensing between source driver ICs, due to calibration errors, in the second calibration method in the related art.

The advantages and features of the present disclosure and methods of accomplishing the same may be understood more readily by reference to the following detailed descriptions of exemplary aspects and the accompanying drawings. The present disclosure may, however, be embodied in many different forms and should not be construed as being limited to the exemplary aspects set forth herein. Rather, these exemplary aspects are provided so that this disclosure will be thorough and complete and will fully convey the concept of the present disclosure to those skilled in the art, and the present disclosure is defined by the appended claims.

The shapes, sizes, percentages, angles, numbers, etc. shown in the figures to describe the exemplary aspects of the present disclosure are merely examples and not limited to those shown in the figures. Like reference numerals denote like elements throughout the specification. In describing the present disclosure, detailed descriptions of related well-known technologies will be omitted to avoid unnecessary obscuring the present disclosure. When the terms 'comprise', 'have', 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'under', 'next to' and the like, one or more parts may be positioned between the two parts as long as the term 'immediately' or 'directly' is not used.

It will be understood that, although the terms first, second, etc., may be used to describe various elements, these elements should not be limited by these terms. These terms are only used to distinguish one element from another element.

Like reference numerals denote like elements throughout the specification.

The sizes and thicknesses of the components shown in the drawings are illustrated for explanatory convenience, but the present disclosure is not necessarily limited thereto.

The features of various exemplary aspects of the present disclosure may be combined with one another either partly or wholly, and may technically interact or work together in various ways. The exemplary aspects may be carried out independently or in combination with one another.

Hereinafter, an exemplary aspect of the present disclosure will be described in detail with reference to the attached drawings.

Figure 5:
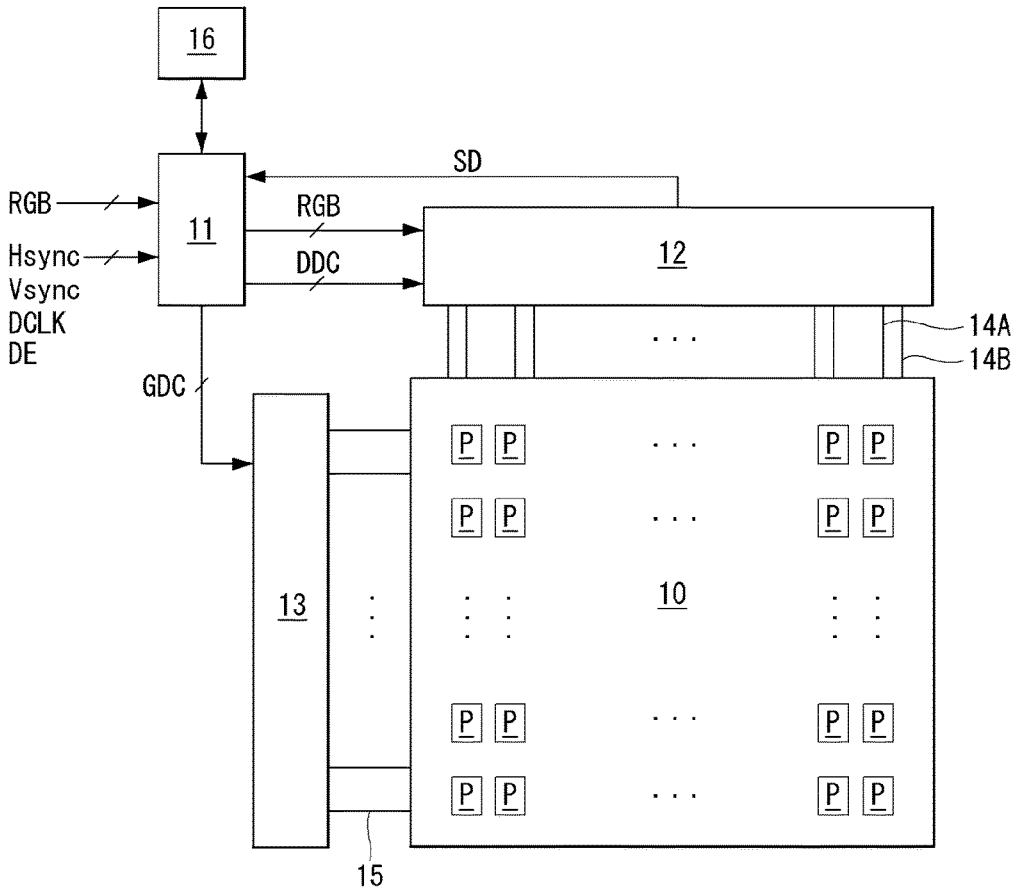
FIG. 5 shows an organic light-emitting display according to an exemplary aspect of the present disclosure.
Figure 6:
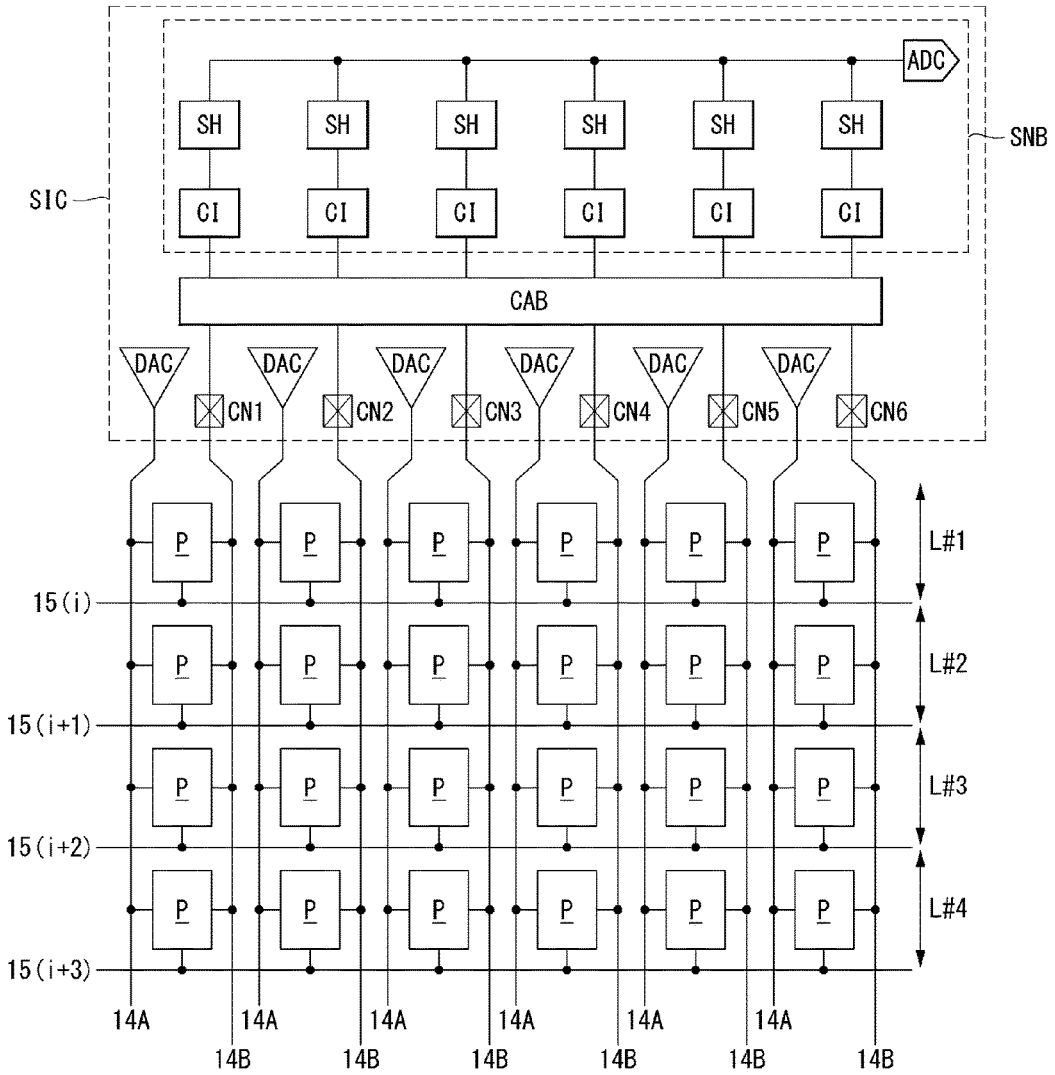
FIG. 6 shows an internal configuration of a source driver IC and a configuration of a pixel array.

FIG. 5 shows an organic light-emitting display according to an exemplary aspect of the present disclosure. FIG. 6 shows an internal configuration of a source driver IC and a configuration of a pixel array.

Referring to FIGS. 5 and 6, an organic light-emitting display according to the present disclosure includes a display panel 10, a timing controller 11, a data drive circuit 12, a gate drive circuit 13, and a memory 16.

A plurality of data lines and sensing lines 14A and 14B and a plurality of gate lines 15 intersect on the display panel 10, and pixels P are arranged in a matrix form at every intersection.

In a pixel array, each pixel P is connected to one of the data lines 14A, one of the sensing lines 14B, and one of the gate lines 15 and forms a pixel line L#1 to L#4 as shown in FIG. 6. Each pixel P may be electrically connected to the data line 14A and receive a data voltage from the data line 14A in response to a gate pulse fed through the gate line 15, and output a sensing signal through the sensing line 14B. The pixels arranged on the same pixel line operate simultaneously according to a gate pulse applied from the same gate line (one of 15($i$) to 15($i$+3)).

Each pixel P receives a high-level driving voltage EVDD and a low-level driving voltage EVSS from a power generator (not shown). A pixel P of this disclosure may include an OLED, a driving TFT, a plurality of switching TFTs, and a storage capacitor. The TFTs of the pixel P may be implemented as p-type or n-type. A semiconductor layer of the TFTs of the pixel P may include amorphous silicon, polysilicon, or oxide.

To display an input image, each pixel P may operate differently in a normal operation mode for writing image data RGB to the display panel 10 and in a sensing operation mode for sensing the electrical characteristics of the OLED and the driving TFT. The sensing operation mode may be done during a time period in which image data RGB is not written. For example, the sensing operation mode may be performed during a vertical blanking interval, or during a power-on sequence immediately after system power is applied, or during a power-off sequence immediately after system power is turned off, under the control of the timing controller 11.

Operation modes of this disclosure may further include a calibration mode, in addition to the normal operation mode and the sensing operation mode. The calibration mode is for compensating for offset variations between sensing blocks, and may be performed during a power-off sequence under the control of the timing controller 11.

The data drive circuit 12 includes a plurality of source driver ICs (integrated circuits) SIC to drive the display panel in a segmented area fashion. Each source driver IC SIC includes a plurality of digital-to-analog converters (hereinafter, DACs) connected to the data lines 14A, a sensing block SNB connected to the sensing lines 14B through sensing channels CN1 to CNn, and a calibration block CAB.

In the normal operation mode, the DAC converts digital image data RGB input from the timing controller 11 to a data voltage for image display and supplies it to the data lines 14A, in response to a data control signal DDC. Meanwhile, in the sensing operation mode, the DAC generates a data voltage for sensing and supplies it to the data lines 14A, in response to a data control signal DDC.

In the calibration mode, the calibration block CAB applies test currents to the sensing block SNB. The calibration block CAB may selectively connect two or more discrete current sources to the sensing block SNB and apply a number of test currents to the sensing block SNB, in order to reduce time needed for calibration and minimize calibration errors.

The sensing block SNB includes a plurality of current integrators CI that perform an integration of current information of pixels input through the sensing channels CN1 to CNn in the sensing operation mode, or that perform an integration of a test current fed from the calibration block CAB in the calibration mode, a plurality of sample and holders SH connected to the current integrators CI, and an ADC sequentially connected to the sample and holders SH.

In the sensing operation mode, the ADC outputs sensing data corresponding to current information of pixels. In the calibration mode, the ADC outputs sensing data SD for calibration of multiple times corresponding to the number of test currents.

In the normal operation mode, the gate drive circuit 13 generates a gate pulse for image display based on a gate control signal GDC, and then sequentially supplies it to the gate lines 15(*i*) to 15(*i*+3). In the sensing operation mode, the gate drive circuit 13 generates a gate pulse for sensing based on a gate control signal GDC, and then sequentially supplies it to the gate lines 15(*i*) to 15(*i*+3).

The timing controller 11 generates the data control signals DDC for controlling the operation timing of the data drive circuit 12 and the gate control signals GDC for controlling the operation timing of the gate drive circuit 13, based on timing signals, such as a vertical synchronization signal Vsync, a horizontal synchronization signal Hsync, a dot clock signal DCLK, and a data enable signal DE. The timing controller 11 determines the mode of operation—normal operation mode, sensing operation mode, and calibration mode—based on a given reference signal (an operating power enable signal, a vertical synchronization signal, a data enable signal, etc.), and activates control signals according to each mode.

In the sensing operation mode, the timing controller calculates a pixel compensation value for compensating for variations in electrical characteristics between pixels based on sensing data input from the ADC, and corrects input image data RGB based on the pixel compensation value. Moreover, the timing controller may improve compensation accuracy by referring to a compensation value for calibration to be described below, as well as the pixel compensation value, when correcting the input image data RGB.

In order to get the compensation value for calibration, the timing controller may further include a sensing data corrector and a compensation value calculator which only operate in the calibration mode.

The sensing data corrector compares sensing data for calibration of multiple times to extract correction values for compensating for variations between discrete current sources and to correct the sensing data for calibration of multiple times with the correction values. The compensation value calculator calculates a compensation value for calibration, for compensating for offset variations between the sensing blocks.

In the present disclosure, the sensing data corrector and the compensation value calculator, along with the calibration block CAB, may configure a calibration device. That is, the calibration device applies test currents to the sensing blocks in order to sense offset variations between the sensing blocks embedded in the source driver ICs, and may comprise the calibration block CAB embedded in the source driver ICs SIC and the sensing data corrector and compensation value calculator embedded in the timing controller 11.

The memory 16 stores the pixel compensation value and the compensation value for calibration.

Figure 7:
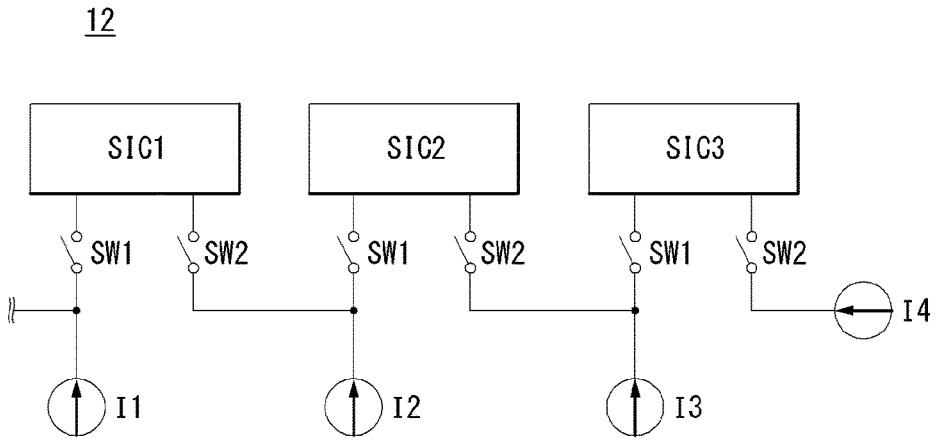
FIG. 7 shows a connection configuration between discrete current sources constituting a calibration block and switches according to the present disclosure.
Figure 8:
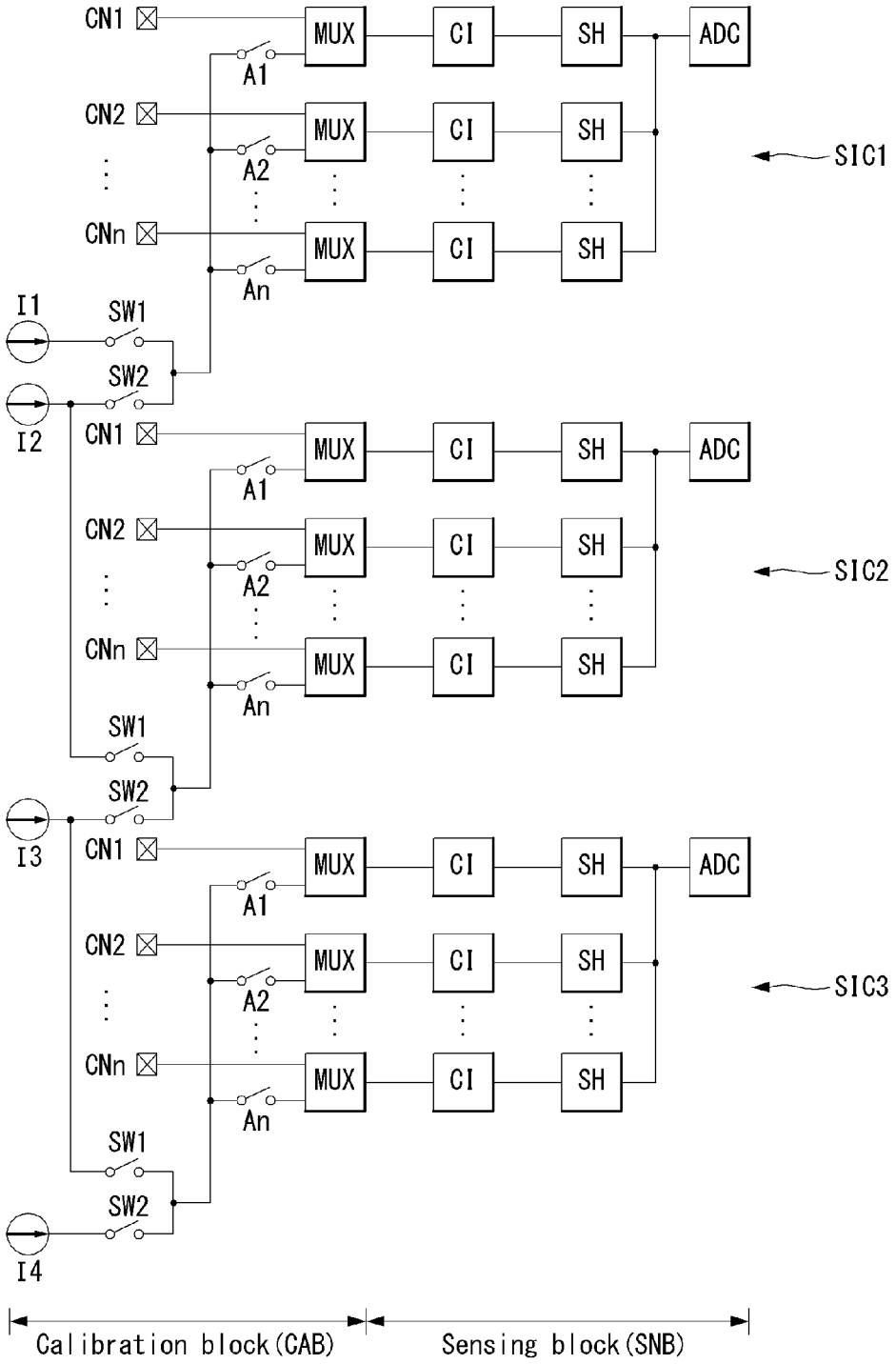
FIG. 8 shows in detail a connection configuration between sensing blocks embedded in source driver ICs and the calibration block.
Figure 9:
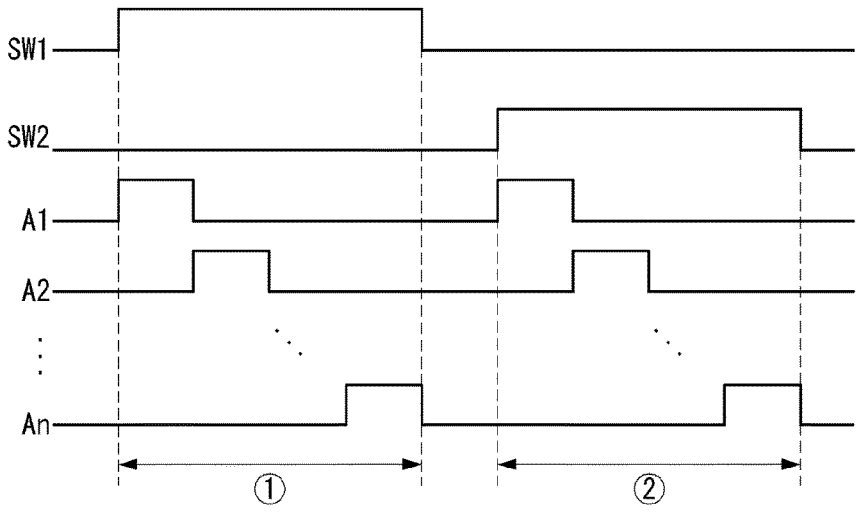
FIG. 9 shows an operation timing of a switch array included in each calibration block of FIG. 8.

FIG. 7 shows a connection configuration between discrete current sources constituting a calibration block and switches according to the present disclosure. FIG. 8 shows in detail a connection configuration between sensing blocks embedded in source driver ICs and the calibration block. FIG. 9 shows an operation timing of a switch array included in the calibration block of FIG. 8.

Referring to FIGS. 7 to 9, in the calibration block CAB, two discrete current sources are selectively connected to each of source driver ICs SIC1, SIC2, and SIC3.

The calibration block CAB includes a plurality of discrete current sources I1, I2, I3, and 14 that generate a test current and a switch array that connects the source driver ICs SIC1, SIC2, and SIC3 and the discrete current sources I1, I2, I3, and I4.

The calibration block CAB includes discrete current sources I1, I2, I3, and I4 in order to reduce time needed for calibration. Moreover, in order to minimize calibration errors due to variations between the discrete current sources, two neighboring source driver ICs share one discrete current source, and each source driver IC SIC1, SIC2, and SIC3 is selectively connected to two discrete current sources to receive two separate test currents from them.

To this end, the switch array includes first switches SW1 and second switches SW2.

The first switches SW1 connect the first discrete current source I1 to the first source driver IC SIC1, the second discrete current source I2 to the second source driver IC SIC2, and the third discrete current source I3 to the third source driver IC SIC3.

The second switches SW2 connect the second discrete current source I2 to the first source driver IC SIC1, the third discrete current source I3 to the second source driver IC SIC2, and the fourth discrete current source I4 to the third source driver IC SIC3.

The first switches SW1 turn on simultaneously only during a first sensing period $\hat{1}$, and the second switches SW2 turn on simultaneously only during a second sensing period $\hat{2}$ subsequent to the first sensing period $\hat{1}$. In this way, two test currents are applied to each source driver IC SIC1, SIC2, and SIC3.

That is, the first source driver IC SIC1 receives a test current from the first discrete current source I1 during the first sensing period $\hat{1}$ and then a test current from the second discrete current source I2 during the second sensing period $\hat{2}$. The second source driver IC SIC2 receives a test current from the second discrete current source I2 during the first sensing period $\hat{1}$ and then a test current from the third discrete current source I3 during the second sensing period $\hat{2}$. The third source driver IC SIC3 receives a test current from the third discrete current source I3 during the first sensing period $\hat{1}$ and then receives a test current from the fourth discrete current source I4 during the second sensing period $\hat{2}$.

Accordingly, the sensing block SNB of each source driver IC SIC1, SIC2, and SIC3 is sequentially connected to two discrete current sources over the first and second sensing periods $\hat{1}$ and $\hat{2}$, and generates sensing data for first calibration and sensing data for second calibration corresponding to the test currents applied from the two discrete current sources.

The sensing block SNB of each source driver IC SIC1, SIC2, and SIC3 has a plurality of multiplexers MUX, a plurality of current integrators CI, and a plurality of sample and holders SH. The multiplexers MUX connect the sensing channels CN1 to CNn to the current integrators CI in the sensing operation mode, and connect the discrete current sources to the current integrators CI in the calibration mode. A plurality of internal switches A1 to An may be connected between the multiplexers MUX and the first and second switches SW1 and SW2. The internal switches A1 to An are for improving sensing accuracy, and, as shown in FIG. 9, may alternately turn on during the first sensing period $\hat{1}$ to sequentially connect one of the two discrete current sources to the current integrators CI in the sensing block SNB, and then alternately turn on during the second sensing period $\hat{2}$ to sequentially connect the other discrete current source to the current integrators CI in the sensing block SNB.

Figure 10:
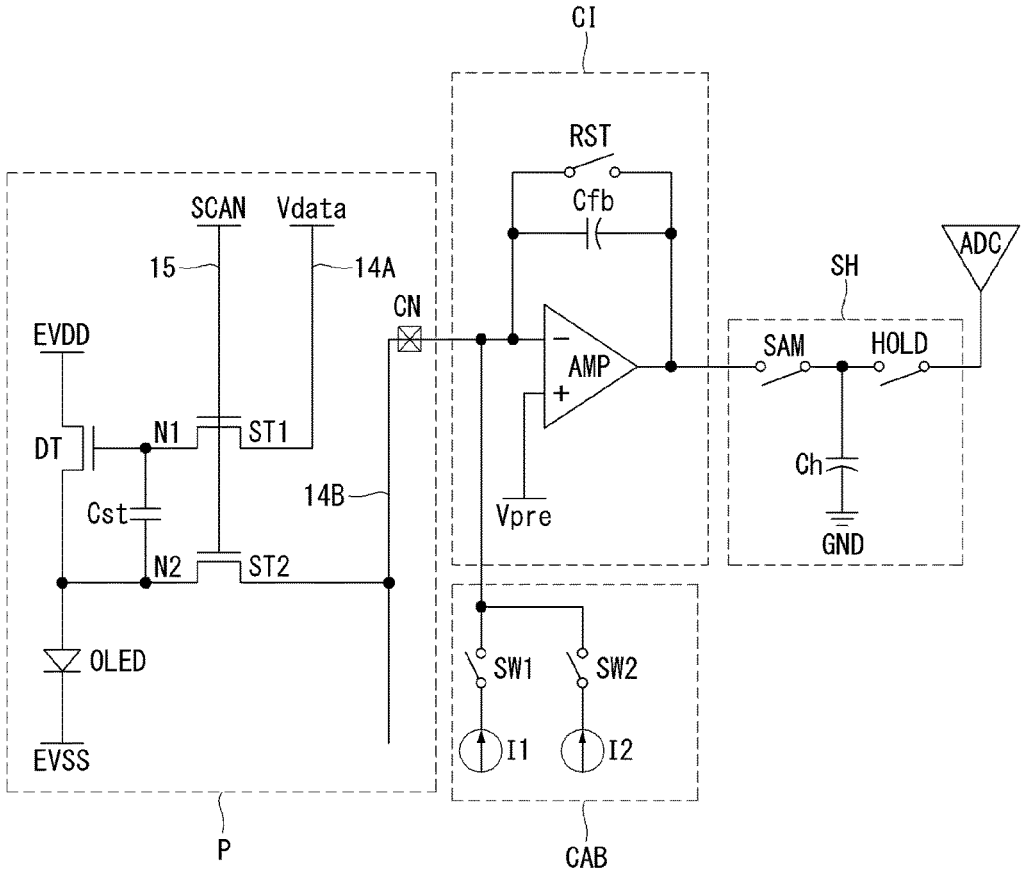
FIG. 10 shows a detailed circuit diagram of a pixel and a sensing block that are connected to each other through one sensing channel.

FIG. 10 shows a detailed circuit diagram of a pixel and a sensing block that are connected to each other through one sensing channel. In FIG. 10, the internal switches A1 to An and multiplexes MUX of FIG. 8 are omitted for convenience of explanation.

Referring to FIG. 10, the pixel P of this disclosure may include an OLED, a driving TFT (thin-film transistor) DT, a storage capacitor Cst, a first switching TFT ST1, and a second switching TFT S2. Such a pixel structure may be altered in various ways, so the technical idea of the present disclosure is not limited to this exemplary aspect.

The OLED emits light by a pixel current. The OLED includes an anode connected to a second node N2, a cathode connected to an input terminal of low-level driving voltage EVSS, and organic compound layers disposed between the anode and the cathode. The driving TFT DT controls the pixel current fed to the OLED by a gate-source voltage. The driving TFT DT includes a gate electrode connected to a first node N1, a drain electrode connected to an input terminal of high-level driving voltage EVDD, and a source electrode connected to the second node N2. The storage capacitor Cst is connected between the first node N1 and the second node N2 and stores the gate-source voltage of the driving TFT DT. The first switching TFT ST1 applies a data voltage Vdata on the data line 14A to the first node N1 in response to a gate pulse SCAN. The first switching TFT ST1 includes a gate electrode connected to the gate line 15, a drain electrode connected to the data line 14A, and a source electrode connected to the first node N1. The second switching TFT ST2 switches the current flow between the second node N2 and the sensing line 14B in response to the gate pulse SCAN. The second switching TFT ST2 includes a gate electrode connected to a second gate line 15D, a drain electrode connected to the sensing line 14B, and a source electrode connected to the second node N2.

A current integrator CI of this disclosure includes an amp AMP, an integrating capacitor Cfb, and a reset switch RST. The amp AMP includes an inverting input terminal (−) that is selectively connected to a sensing channel CN and a calibration block CAB, a non-inverting input terminal (+) to which a reference voltage Vpre is applied, and an output terminal that outputs an integrated value. The integrating capacitor Cfb is connected between the inverting input terminal (−) and output terminal of the amp AMP and accumulates a pixel current. The reset switch RST is connected in parallel to the integrating capacitor Cfb between the inverting input terminal (−) and output terminal of the amp AMP.

A sample and holder SH of this disclosure includes a sampling switch SAM, a holding capacitor Ch, and a holding switch HOLD. When the sampling switch SAM turns on, the output of the current integrator CI is stored in the holding capacitor Ch. When the holding switch HOLD turns on, the voltage stored in the holding capacitor Ch is applied to the ADC.

The ADC of this disclosure converts the output of the sample and holder SH from analog to digital to create digital sensing data representing the electrical characteristics of the pixels or sensing data for calibration.

Figure 11:
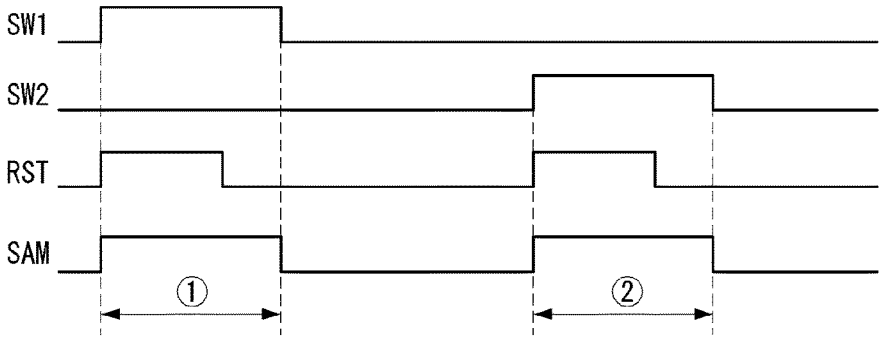
FIG. 11 shows operating waveforms of switches to explain a calibration operation according to the present disclosure.
Figure 12A:
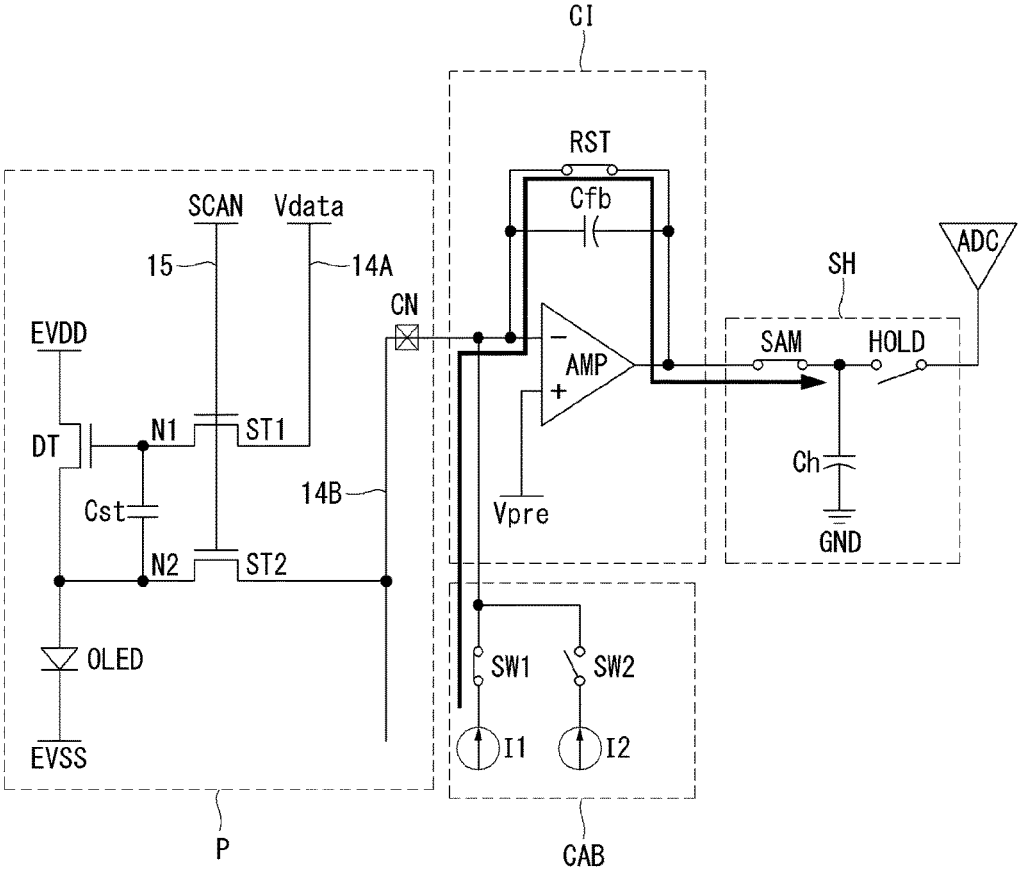
FIG. 12A shows operations of the calibration block and the sensing block during the first sensing period of FIG. 11.
Figure 12B:
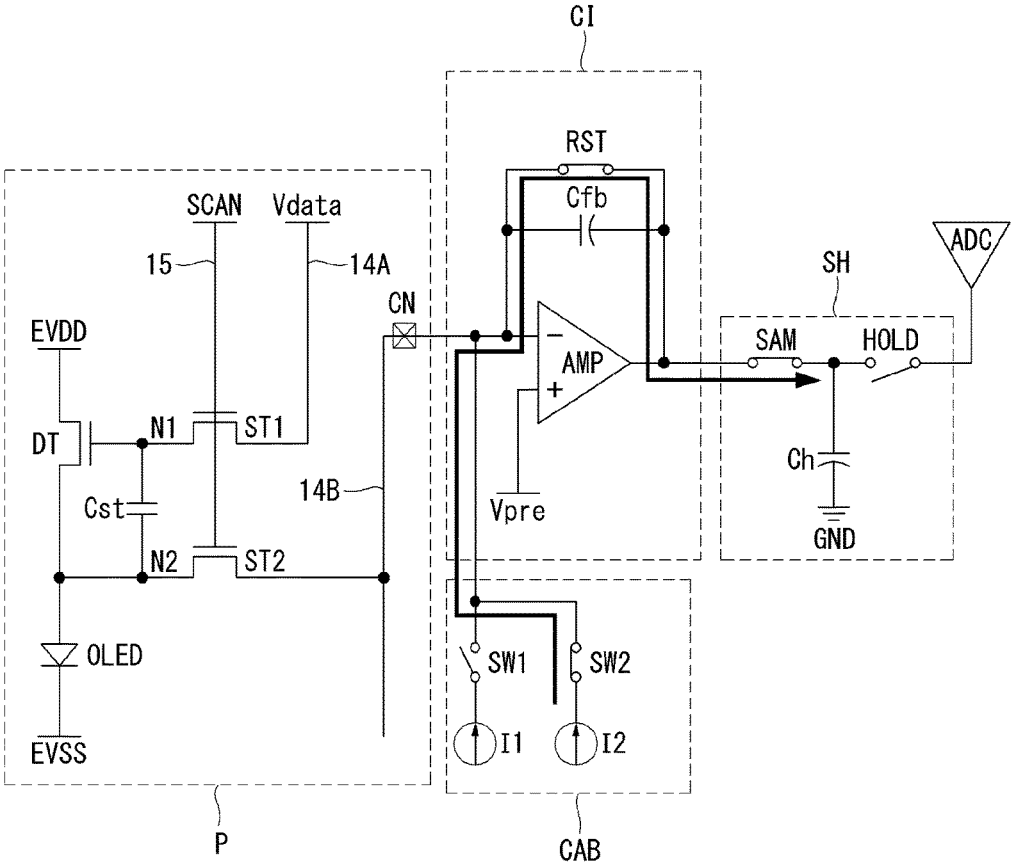
FIG. 12B shows operations of the calibration block and the sensing block during the second sensing period of FIG. 11.

FIG. 11 shows operating waveforms of switches to explain a calibration operation according to the present disclosure. FIG. 12A shows operations of the calibration block and the sensing block during the first sensing period of FIG. 11. FIG. 12B shows operations of the calibration block and the sensing block during the second sensing period of FIG. 11.

Referring to FIGS. 11 and 12A, in the first sensing period $\hat{1}$, the first switch SW1 of the calibration block CAB, the reset switch RST of the current integrator CI, and the sampling switch SAM of the sample and holder SH turn on. In the first sensing period $\hat{1}$, the second switch SW2 remains turned off.

In the first sensing period $\hat{1}$, a test current generated by the first discrete current source I1 passes through the current integrator CI and the sampling switch SAM and is stored in the holding capacitor Ch. The ADC converts the output of the holding capacitor Ch applied through the holding switch HOLD from analog to digital to create sensing data for first calibration.

Referring to FIGS. 11 and 12B, in the second sensing period $\hat{1}$, the second switch SW2 of the calibration block CAB, the reset switch RST of the current integrator CI, and the sampling switch SAM of the sample and holder SH turn on. In the second sensing period $\hat{2}$, the first switch SW1 remains turned off.

In the second sensing period $\hat{2}$, a test current generated by the second discrete current source I2 passes through the current integrator CI and the sampling switch SAM and is stored in the holding capacitor Ch. The ADC converts the output of the holding capacitor Ch applied through the holding switch HOLD from analog to digital to create sensing data for second calibration.

Figure 13:
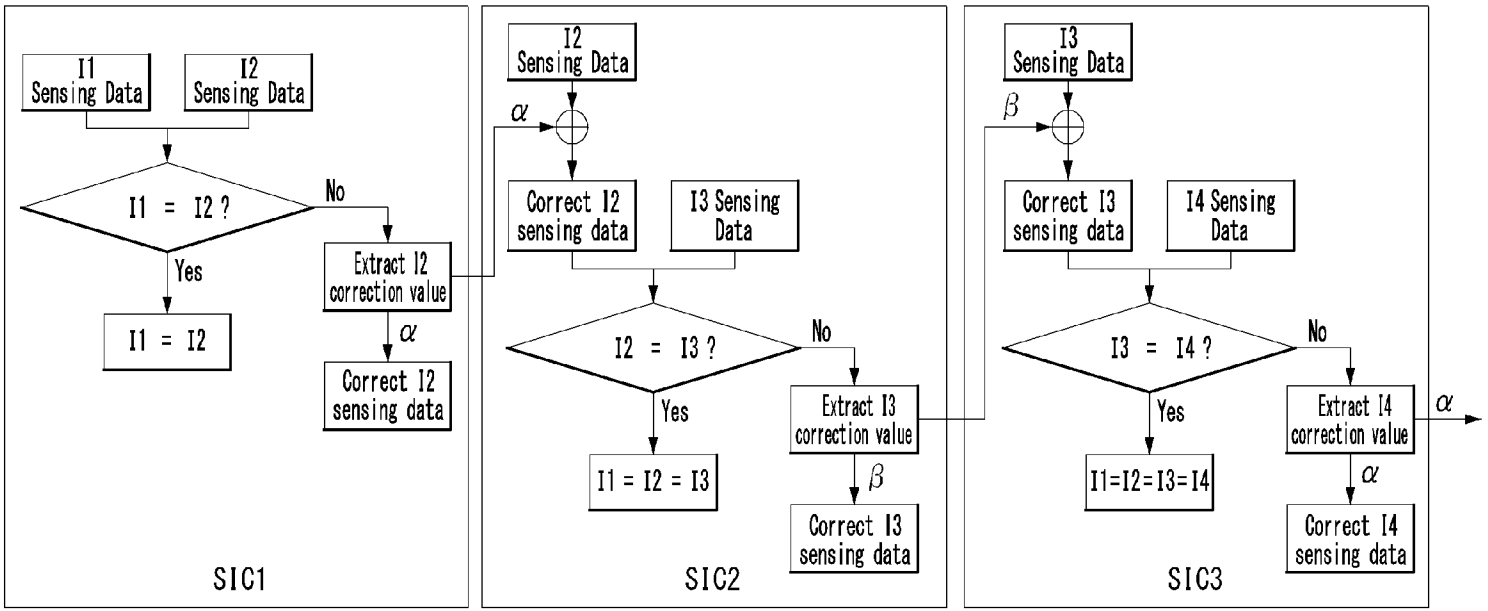
FIG. 13 shows an example of correcting for variations between discrete current sources according to the present disclosure.
Figure 14:
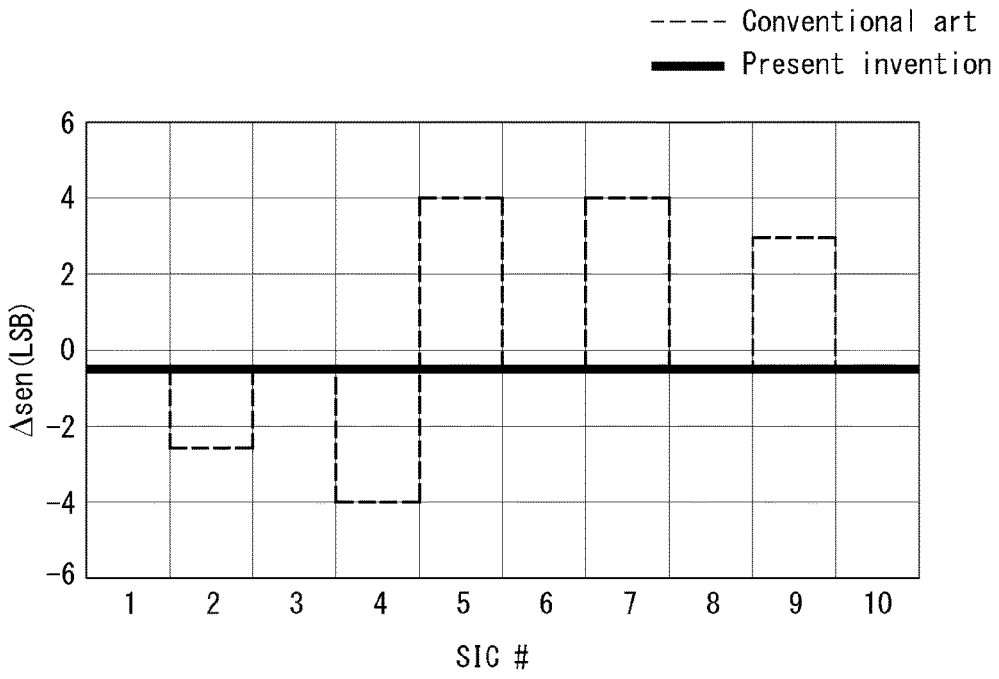
FIG. 14 shows an effect of improvement in calibration errors according to the present disclosure compared to the related art.

FIG. 13 shows an example of correcting variations between discrete current sources according to the present disclosure. FIG. 14 shows the effect of improvement in calibration errors according to the present disclosure compared to the related art.

Referring to FIG. 13, the sensing data corrector of this disclosure compares sensing data for I1 calibration and sensing data for I2 calibration that are input from the first source driver IC SIC1 and extract a first correction value $\alpha$ for correcting a variation between the first and second discrete current sources I1 and I2. In an example, the sensing data corrector may extract the first correction value $\alpha$ based on the sensing data for I1 calibration, in which case the sensing data for I2 calibration may be corrected with the first correction value, which corresponds to the difference between the sensing data for I1 and I2 calibrations.

Subsequently, the sensing data corrector of this disclosure corrects the sensing data for I2 calibration, input from the second source driver SIC2, with the first correction value $\alpha$, and then compares the sensing data for I2 calibration and the sensing data for I3 calibration to extract a second correction value β for correcting for a variation between the second and third discrete current sources I2 and I3. The sensing data corrector may extract the second correction value β based on the corrected sensing data for I2 calibration, in which case the sensing data for I3 calibration may be corrected with the second correction value β, which corresponds to the difference between the sensing data for I2 and I3 calibrations.

In this way, the sensing data corrector of this disclosure may significantly reduce calibration errors due to variations between discrete current sources compared to the related art, as shown in FIG. 14, by comparing sensing data for two calibrations input from each source driver IC, extracting a correction value for compensating for a variation between the discrete current sources, and then correcting the sensing data for the latter of the two calibrations with the correction value.

Figure 15:
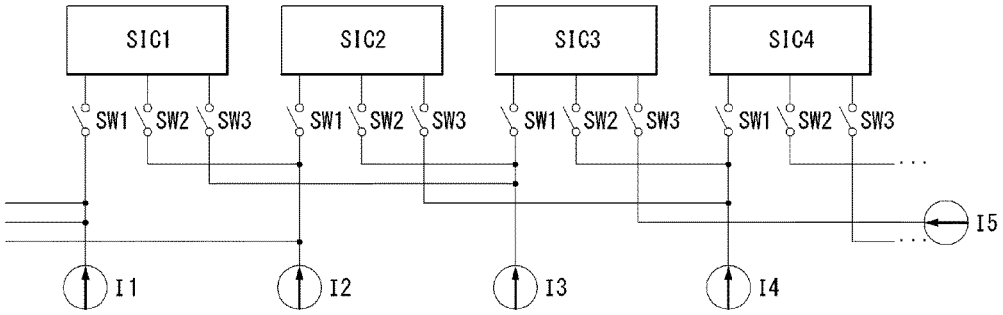
FIG. 15 shows another connection configuration between sensing blocks embedded in source driver ICs and the calibration block.
Figure 16:
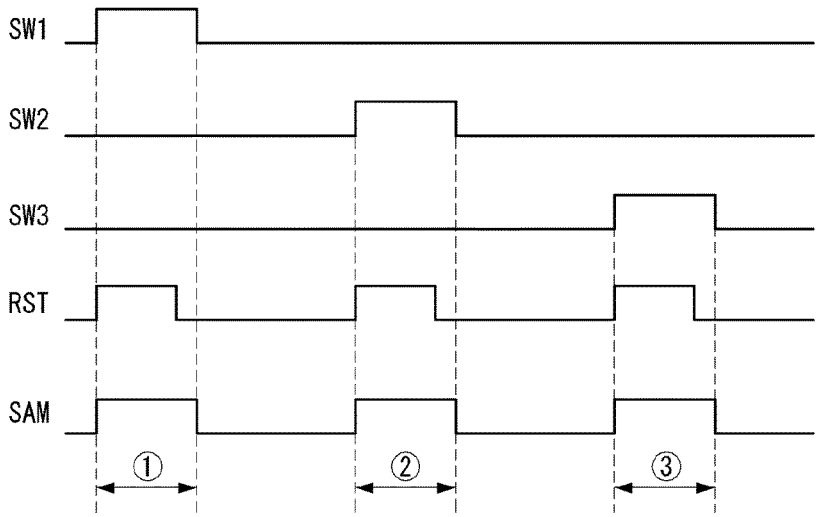
FIG. 16 shows operating waveforms of switches to explain another calibration operation according to the present disclosure.

FIG. 15 shows another connection configuration between sensing blocks embedded in source driver ICs and the calibration block. FIG. 16 shows operating waveforms of switches to explain another calibration operation according to the present disclosure.

Referring to FIGS. 15 to 16, the calibration block CAB selectively connects three discrete current sources to each of source driver ICs SIC1, SIC2, SIC3, and SIC4. The more the number of discrete current sources is selectively connected to each source driver IC, the less the amount of errors occurs.

The calibration block CAB includes a plurality of discrete current sources I1, I2, I3, I4, and I5 that generate a test current and a switch array that connects the source driver ICs SIC1, SIC2, SIC3, and SI4 and the discrete current sources I1, I2, I3, I4, and I5.

The calibration block CAB includes discrete current sources I1, I2, I3, I4, and I5 in order to reduce time needed for calibration. Moreover, in order to minimize calibration errors due to variations between the discrete current sources, three neighboring source driver ICs share one discrete current source, and each source driver IC SIC1, SIC2, SIC3, and SIC4 is selectively connected to three discrete current sources to receive three separate test currents from them.

To this end, the switch array includes first switches SW1, second switches SW2, and third switches SW3.

The first switches SW1 connect the first discrete current source I1 to the first source driver IC SIC1, the second discrete current source I2 to the second source driver IC SIC2, the third discrete current source I3 to the third source driver IC SIC3, and the fourth discrete current source I4 to the fourth source driver IC SIC4.

The second switches SW2 connect the second discrete current source I2 to the first source driver IC SIC1, the third discrete current source I3 to the second source driver IC SIC2, the fourth discrete current source I4 to the third source driver IC SIC3, and the fifth discrete current source I5 to the fourth source driver IC SIC4.

The third switches SW3 connect the third discrete current source I3 to the first source driver IC SIC1, the fourth discrete current source I4 to the second source driver IC SIC2, the fifth discrete current source I5 to the third source driver IC SIC3, and a sixth discrete current source (not shown) to the fourth source driver IC SIC4.

The first switches SW1 turn on simultaneously only during a first sensing period $\hat{1}$, the second switches SW2 turn on simultaneously only during a second sensing period $\hat{2}$ subsequent to the first sensing period $\hat{1}$, and the third switches SW3 turn on simultaneously only during a third sensing period $\hat{3}$ subsequent to the second sensing period $\hat{2}$.

In this way, three test currents are applied to each source driver IC SIC1, SIC2, SIC3, and SIC4.

That is, the first source driver IC SIC1 receives a test current from the first discrete current source I1 during the first sensing period $\hat{1}$, then a test current from the second discrete current source I2 during the second sensing period $\hat{2}$, and then a test current from the third discrete current source I3 during the third sensing period $\hat{3}$. The second source driver IC SIC2 receives a test current from the second discrete current source I2 during the first sensing period $\hat{1}$, then a test current from the third discrete current source I3 during the second sensing period $\hat{2}$, and then a test current from the fourth discrete current source I4 during the third sensing period $\hat{3}$. The third source driver IC SIC3 receives a test current from the third discrete current source I3 during the first sensing period $\hat{1}$, then a test current from the fourth discrete current source I4 during the second sensing period $\hat{2}$, and then a test current from the fifth discrete current source I5 during the third sensing period $\hat{3}$.

Accordingly, the sensing block SNB of each source driver IC SIC1, SIC2, SIC3, and SIC4 is sequentially connected to three discrete current sources over the first to third sensing periods $\hat{1}$, $\hat{2}$, and $\hat{3}$ and generates sensing data for first calibration, sensing data for second calibration, and sensing data for third calibration corresponding to the test currents applied from the three discrete current sources.

As described above, the present disclosure can reduce time needed for calibration by using a plurality of discrete current sources when calibrating variations in characteristics between sensing blocks. Moreover, the present disclosure allows applying a number of test currents to each sensing block by selectively connecting two or more discrete current sources to each sensing block. Additionally, the present disclosure can effectively compensate for variations between the discrete current sources by obtaining sensing data for calibration of multiple times and comparing the sensing data for calibration of multiple times to compensate for variations. As such, the present disclosure can reduce time required for calibration and, at the same time, significantly reduce calibration errors due to variations between discrete current sources.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

What is claimed is:

1. An organic light emitting display comprising: a display panel having a plurality of pixels; and a plurality of source driver ICs (integrated circuits) comprising sensing blocks connected to the pixels and sensing electrical characteristics of the pixels and a calibration block applying test currents to the sensing blocks; wherein the calibration block comprises a plurality of discrete current sources generating the test currents; and a switch array connecting the source driver ICs with discrete current sources of the calibration block, wherein two or more neighboring source driver ICs share one discrete current source, and each source driver IC is selectively connected to the plurality of discrete current sources.

2. The organic light-emitting display of claim 1, wherein the switch array comprises:

first switches respectively connecting a first discrete current source to a first source driver IC, a second discrete current source to a second source driver IC, and a third discrete current source to a third source driver IC; and second switches respectively connecting the second discrete current source to the first source driver IC, the third discrete current source to the second source driver IC, and a fourth discrete current source to the third source driver IC.

3. The organic light-emitting display of claim 2, wherein the switch array comprises third switches respectively connecting the third discrete current source to the first source driver IC, the fourth discrete current source to the second source driver IC, and a fifth discrete current source to the third source driver IC.

4. The organic light-emitting display of claim 3, wherein the first switches turn on simultaneously only during a first sensing period, the second switches turn on simultaneously only during a second sensing period subsequent to the first sensing period, and the third switches turn on simultaneously only during a third sensing period subsequent to the second sensing period.

5. The organic light-emitting display of claim 1, wherein the sensing block of each source driver IC is sequentially connected to the two or more discrete current sources through a plurality of sensing periods, and generates sensing data for at least two calibrations corresponding to the test currents applied from the two or more discrete current sources.

6. The organic light-emitting display of claim 5, further comprising a timing controller that processes the sensing data for the least two calibrations, the timing controller comprising:

a sensing data corrector comparing the sensing data for the at least two calibrations to extract correction values for compensating for variations between the discrete current sources and to correct the sensing data for the at least two calibrations with the correction values; and a compensation value calculator calculating a compensation value for calibration, for compensating for offset variations between the sensing blocks, based on the corrected sensing data for calibration.

7. A calibration method for an organic light-emitting display, in which test currents are applied to sensing blocks by using a plurality of discrete current sources, the calibration method comprising:

obtaining sensing data for first calibration by respectively connecting a first source driver IC (integrated circuit) to a first discrete current source, a second source driver IC to a second discrete current source, and a third source driver IC to a third discrete current source, during a first sensing period;

obtaining sensing data for second calibration by respectively connecting the first source driver IC to the second discrete current source, the second source driver IC to the third discrete current source, and the third source driver IC to a fourth discrete current source, during a second sensing period subsequent to the first sensing period; and comparing the sensing data for at least two calibrations to extract correction values for compensating for variations between the discrete current sources and to correct the sensing data for the at least two calibrations with the correction values.

8. The calibration method of claim 7, wherein the sensing data for the at least two calibrations comprises sensing data for first, second and third calibrations.

9. The calibration method of claim 8, wherein the sensing data for the third calibration is obtained by respectively connecting the first source driver IC to the third discrete current source, the second source driver IC to the fourth discrete current source, and the third source driver IC to a fifth discrete current source, during a third sensing period subsequent to the second sensing period.

10. The calibration method of claim 7, further comprising calculating a compensation value for calibration, for compensating for offset variations between the sensing blocks, based on the corrected sensing data for calibration.

11. A calibration device for applying a plurality of test currents to sensing blocks embedded in each of source driver ICs (integrated circuits), the calibration device comprising: a plurality of discrete current sources generating the test currents; and a switch array connecting each of the source driver ICs to the discrete current sources, wherein two or more neighboring source driver ICs share one discrete current source, and each source driver IC is selectively connected to two or more discrete current sources.

12. The calibration device of claim 11, wherein the switch array comprises:

first switches respectively connecting a first discrete current source to a first source driver IC, a second discrete current source to a second source driver IC, and a third discrete current source to a third source driver IC; and second switches respectively connecting the second discrete current source to the first source driver IC, the third discrete current source to the second source driver IC, and a fourth discrete current source to the third source driver IC.

13. The calibration device of claim 12, further comprising third switches respectively connecting the third discrete current source to the first source driver IC, the fourth discrete current source to the second source driver IC, and a fifth discrete current source to the third source driver IC.

14. The calibration device of claim 13, wherein the first switches turn on simultaneously only during a first sensing period, the second switches turn on simultaneously only during a second sensing period subsequent to the first sensing period, and the third switches turn on simultaneously only during a third sensing period subsequent to the second sensing period.

15. The calibration device of claim 11, wherein the sensing block of each source driver IC is sequentially connected to the two or more discrete current sources over a plurality of sensing periods, and generates sensing data for at least two calibrations corresponding to the test currents applied from the two or more discrete current sources.

16. The calibration device of claim 15, further comprising:

a sensing data corrector that compares the sensing data for the at least two calibrations to extract correction values for compensating for variations between the discrete current sources and to correct the sensing data for the at least two calibrations with the correction values; and a compensation value calculator that calculates a compensation value for calibration, for compensating for offset variations between the sensing blocks, based on the corrected sensing data for calibration.

17. A calibration device for minimizing an error and a tack time in calibrating an organic light emitting display, comprising: a plurality of sensing blocks embedded in each of source driver ICs (integrated circuits) and outputting sensing data for at least two calibrations through an analog-to-digital converter corresponding to a plurality of test currents in a calibration mode; a calibration block applying the plurality of test currents to the sensing blocks, wherein the test currents are selectively applied to each of the sensing blocks through at least two discrete current sources in the calibration mode; and a timing controller calculating a pixel compensation value for compensating for variations in electrical characteristics of pixels based on the sensing data in a sensing mode and compensating for input image data based on the pixel compensation value.

18. The calibration device of claim 17, wherein the timing controller calculates a calibration compensation value in addition to the pixel compensation value.

19. The calibration device of claim 18, wherein the calibration compensation value is generated through a sensing data corrector and a compensation value calculator.

20. The calibration device of claim 19, wherein the sensing data corrector and the compensation value calculator operate only in the calibration mode.

* * * * *